US011246378B2

(12) United States Patent
Baptista De Souza

(10) Patent No.: US 11,246,378 B2
(45) Date of Patent: Feb. 15, 2022

(54) STRING GUIDE MODULE AND USE THEREOF IN A MACHINE WITH A STRING PULLER

(71) Applicant: I.S.A. INDÚSTRIA DE TECNOLOGIA E AUTOMACÃO LTDA. (INDUSTRY AND TECHNOLOGY LTDA), Nova Hamburgo (BR)

(72) Inventor: Silvano Baptista De Souza, Novo Hamburgo (BR)

(73) Assignee: I.S.A. INDÚSTRIA DE TECNOLOGIA E AUTOMACÂO LTDA. (INDUSTRY AND TECHNOLOGY LTDA), Novo Hamburgo (BR)

( * ) Notice: Subject to any disclaimer, the term of this patent is extended or adjusted under 35 U.S.C. 154(b) by 60 days.

(21) Appl. No.: 16/483,704

(22) PCT Filed: Mar. 24, 2017

(86) PCT No.: PCT/BR2017/050072

§ 371 (c)(1),
(2) Date: Aug. 5, 2019

(87) PCT Pub. No.: WO2018/141036

PCT Pub. Date: Aug. 9, 2018

(65) Prior Publication Data

US 2020/0022459 A1 Jan. 23, 2020

(30) Foreign Application Priority Data

Feb. 6, 2017 (BR) ..... BR1020170024008

(51) Int. Cl.
*A43B 15/00* (2006.01)
*A43D 15/00* (2006.01)
*A43D 11/00* (2006.01)

(52) U.S. Cl.
CPC ..... *A43D 15/00* (2013.01); *A43D 11/00* (2013.01)

(58) Field of Classification Search
CPC ..... A43D 15/00; A43D 11/00
(Continued)

(56) References Cited

U.S. PATENT DOCUMENTS 1,833,229 A * 11/1931 Sahr ..... A43D 9/00 12/7.3
2,226,758 A * 12/1940 Fausse ..... A43D 21/12 12/7.3

(Continued)

FOREIGN PATENT DOCUMENTS

BR 20130228591 A2 9/2015

*Primary Examiner* — Marie D Bays
(74) *Attorney, Agent, or Firm* — McKee, Voorhees & Sease, PLC

(57) ABSTRACT

The present application for Patent of Invention describes a strand guide module which enables the use of locks to be fully eliminated for adjusting the waist, considerably improving the quality and comfort of the footwear, besides economizing raw materials and improving productivity. The purpose of the object of the invention is to allow for longitudinal, latitudinal and angular adjustment of the pulling vector of the strands, particularly the longitudinal positional adjustment along the last (F), including modularity characteristics.

7 Claims, 5 Drawing Sheets

(58) Field of Classification Search
USPC ..... 12/7.9
See application file for complete search history.

(56) References Cited

U.S. PATENT DOCUMENTS

| | | | | | |
|---|---|---|---|---|---|
| 2,344,503 | A * | 3/1944 | Cuozzo | A43D 9/00 | 12/145 |
| 3,474,475 | A * | 10/1969 | Wilbur | A43D 11/00 | 12/7.9 |
| 3,778,856 | A * | 12/1973 | Christie | A43D 11/00 | 12/7.9 |
| 3,972,086 | A * | 8/1976 | Belli | A43D 15/00 | 12/7.9 |
| 2018/0140055 | A1* | 5/2018 | De Souza | A43D 15/00 | |
| 2020/0022459 | A1* | 1/2020 | Baptista De Souza | A43D 11/00 | |
| 2020/0154816 | A1* | 5/2020 | Gaba | A43C 1/04 | |

* cited by examiner

STRING GUIDE MODULE AND USE THEREOF IN A MACHINE WITH A STRING PULLER

FIELD OF THE INVENTION

The present application for Patent of Invention refers to a strand guide module, its primary application being in the footwear sector.

More specifically, the module of the present invention broadens the field of application of the SHOE UPPER MOUNTING MACHINE WITH STRAND PULLER, object of patent application BR102015013357-0, in the name of I.S.A. Industria de Tecnologia and Automação Ltda-EPP (now applicant of the present patent application), because its action is decisive in the integral assembly integral of footwear of more complex and structured models, such as high-heeled shoes, with high upper, with short or long tops. The module also improves the productive capacity of the machine's operational process, generating increased economy and higher quality, by providing a perfect sealing assembly, from the shoe upper to the last, in just one pulling procedure, with a single cross-stitch.

Therefore, the field of application of the STRAND GUIDE MODULE is equal to or greater than the field of application for which the SHOE UPPER MOUNTING MACHINE WITH STRAND PULLER is intended. The machine previously filed was designed to be used in all strand-assembly situations, including footwear models previously excluded from this technique by having tough shoe uppers, low-flexibility and hard to be shaped by pulling the strand. Accordingly, it is suffice to establish new dimensions adapted to the assembly technique for the shoe upper, when necessary. The machine is able to pull any strand causing the adjustment of any shoe upper on the last, provided that these materials follow acceptable quality standards for footwear components.

This being the case, the machine cited and previously filed can be used for assembling the following footwear models: kids, women, men and safety, sports, casual or formal, such as pumps, trainers, shoes, scarpins, boots, ankle boots, peep toes, etc. In this sense, the strand guide module can operate positively, as demonstrated ahead in this patent application.

Further in relation to previous machine, its placement in the industry encompasses different layouts defined by the different needs for each footwear model to be manufactured. In this way, it can be placed on assembly mats, or in technological cells on sole injectors, which inject polymers directly on the mounted shoe upper, in independent places, etc.

BACKGROUND OF THE INVENTION

After developing the equipment that is the object of patent application BR102015013357-0, entitled SHOE UPPER MOUNTING MACHINE WITH STRAND PULLER, the inventor began working on the applicability of the assembly method.

Initially, the method proved to be efficient. However, the irregularities in the position of the fabric locks, led the inventor to seek an alternative solution. Thus the X-cross stitching was born, which needed to be improved in terms of execution and position.

At this time, an "X" for flat footwear was used and more than one "X", as necessary, for footwear with a greater number of negative angles, that is, heeled shoes and boots.

During testing, it was noted that by changing the strand pull angle and the position of the "X", it was possible to determine which part of the footwear should first undergo the pulling force of the strand. Adding these factors to the strength of the edges of the last, it was possible to achieve, in a single strand pulling procedure, the perfect and simultaneous adjustment of the shoe upper to the last, copying the lines of the last, without causing tension lines.

It was thus possible to see that for each footwear model, for each negative angle, there is a most suitable position of the "X", in addition to the most suitable pulling angle, that is, in most cases, only one cross-stitch is sufficient for properly seating the shoe upper on the last.

STATE OF THE ART

The module of the invention and its application technique were entirely developed by the inventor, after the creation and the development of the SHOE UPPER MOUNTING MACHINE WITH STRAND PULLER and, in conjunction with the creation and development of the X-SEWING METHOD FOR ASSEMBLING SHOE UPPERS BY THE TIED STRAND SYSTEM, to be added, optionally, to the SHOE UPPER MOUNTING MACHINE, as previously cited. In other words, prior to the creation of the SHOE UPPER MOUNTING MACHINE, with its features and innovations, it was not possible to design the footwear assembly of more structured or complex models by the strand method, so before the machine of the patent application cited, there was no need for an X-SEWING METHOD, OR A STRAND GUIDE MODULE.

In this sense, the groundwork made by the inventor and filed by the applicant prompted the development of the SHOE UPPER MOUNTING MACHINE and subsequently the STRAND GUIDE MODULE simultaneously to the SEWING METHOD. This research, begun some time ago, was mainly supported by the observation and diagnosis of industries located in Brazilian industrial complexes which commonly used the assembly method by strand tension system, for the assembly of light footwear, such as women's pumps or children's trainers, carried out manually or with the assistance of rudimentary devices, which did not have characteristics capable of rendering the method viable.

In other words, in low-yield processes, the shoe upper can be mounted on the last and manually pinned with tacks, which are a type of metal nail specially produced for this purpose, or with synthetic adhesives. It can also be mounted with the assistance of forepart and shoe-making machines which respectively mounts the forepart and rearpart of the footwear, separately, using thermopastic adhesives.

In high-scale production processes, the shoe upper can be mounted essentially by the strand method, where an overcast stitch is made on the edges of the shoe upper and on a strand for tieing. When this strand is pulled, it compresses the entire edge of the shoe upper into a lace, wrinkling it. The result and the adjustment of the shoe upper against the lower part of the last, making it ready to receive the sole. An inner sole may or may not be sewn onto the shoe upper. The sole may be joined to the shoe upper by tack (type of nail for this function), adhesive, or direct sole injection.

In these high productivity procedures, the shoe upper can also be mounted by Strobel (German company), where it is previously shaped, that is, it is given the format of the foot, by specific machines, thereafter, fully sewn to an inner sole, in an overcast sewing machine and only then bagged onto the last.

Traditionally, the assembly tasks of the last on the shoe upper and strand pulling, in assembly processes by the strand method, are carried out manually by two technicians, one for each step, who only use simple utensils as facilitators.

For these jobs, the workers normally use a support bench, which has a fastening pin of the last, in addition to the manual shoe horn and potentially gloves for protection. This bench does not have devices for fine tuning of positioning and both the placement of the shoe upper on the last, since the pulling of the strand depends exclusively of the strength and the skill of the operator in charge.

There is auxiliary mechanical equipment that proposes to pull the strand by machine, but its functionality is restricted to this pulling, with fixed, preset strength.

One of the known equipment, with a specific strand pull function for assembly of footwear by way of the strand method and manufactured by the company SAZI in Farroupilha, RS.

This equipment is more commonly used jointly with sole injectors for direct injection.

This equipment is summarized in a motor system that winds the strand terminals on a rotary shaft. With longitudinal slots for incasing the strand, this shaft is driven by pedal connecting a gear motor. The reversal of this rotation for unwinding the strand occurs when so commanded by the operator, through the pedal.

In this case, there is no proportional control of strength and pulling speed that translates the command given by the operator and contemplates the needs of minor variations in the course of each pull. This apparatus only pulls the strand, does not have a module for jointly performing the task of assembling the shoe upper on the last, nor does it have an automatic shoe horn with proportional control of strength, as is the SHOE UPPER MOUNTING MACHINE WITH STRAND PULLER, developed by the same inventor. Additionally, this equipment does not have STRAND GUIDE MODULE, since its generation was directed to the footwear assembly of soles from flat, low-structured and low-valued footwear.

Therefore, this rotary shaft system described above and its tension principle do not conflict with the constructive arrangement of the SHOE UPPER MOUNTING MACHINE WITH STRAND PULLER, nor does it incorporate or present a STRAND GUIDE MODULE, or any other tool with this functionality, or intended for this purpose.

Another known and commercialized system is a strand puller, developed from conception by the same inventor, the initial design of which generated supporting information on its functioning and feasibility for use in high-scale production, now improved, thus claimed in the design in question.

The invention relates to a pneumatic system, with a fastening collet of the strand and linear actuator for movement of the collet and consequent pulling of the strand. The actuation command of the system is by foot pedal, but the principle of this model is to generate the movement of the pressure differential of the return camera of the actuator relative to the pulling or advancing camera. This equipment does not have a STRAND GUIDE MODULE either, or any other tooling with such functionality, or intended for this purpose.

Problems Related to the State of the Art

When the strands are pulled manually or by simple devices and auxiliary tools, in the act of assembling shoe uppers by strand pulling, THE FORCE IS THE PULLING DIRECTION (tension vector), are completely random and limited to the physical characteristics and to the individual discernment of the operator, even when it uses simplified devices with the basic aim of imparting strength to the strand tension. The use of the strand pulling assembly system is limited to the footwear assembly of flat, low-upper soles, with flexible shoe uppers and low-structured composition, composed with sufficient characteristics for manufacturing footwear with low aggregate value, such as, for example, pumps and children's trainers.

The pulling vector of the strands came to exist only as of the development, by the inventor linked to I.S.A. (now applicant) of the SHOE UPPER MOUNTING MACHINE WITH STRAND PULLER, since it was only from this moment onwards that conditions were created so that it was possible to design the strand assembly of footwear models with more complex characteristics, such as high heels, high uppers, long or short tops, less flexible and more structured shoe uppers. This equipment has proportional controls of speed and strength, besides features, tools and complementary modules capable of enhancing machine actuation, to all known footwear models.

Initially, the method proved to be efficient. However, the irregularities in the position of the fabric locks prompted the company to seek an alternative solution. Thus, cross-stitching was born, called X-SEWING METHOD FOR ASSEMBLING SHOE UPPERS BY THE TIED STRAND SYSTEM and the STRAND GUIDE MODULE, the proceeding number of the priority patent application being eBR 10 2016 024771 3, in the name of the now applicant. This sewing strategy needed improvement in terms of execution and positioning.

At the first moment, an "X" was used for flat footwear and more than one "X", as necessary, for footwear with a greater number of angular variations, that is, heeled shoes, or with high upper, long or short tops, such as boots and scarpins.

During testing, it was noted that by altering the strand pull angle and the position of the "X", it was possible to determine which part of the footwear should first undergo the pulling force of the strand. Relating these factors to the strength of the edges of the last, it has been possible to achieve, in a single strand pulling procedure, the perfect and simultaneous adjustment of the shoe upper to the last, copying the lines of the last, without causing tension lines.

To guarantee the position and the correct angle of tension, the STRAND GUIDE MODULE was developed, with freedom of angular and longitudinal movements.

It was thus possible to see that for each footwear model, there is a most suitable position of the "X", in addition to the most suitable pulling angle, that is, in most cases, only one cross-stitch is sufficient for properly seating the shoe upper to the last.

In this way, a new technology was born for assembling footwear, which includes a machine for assembling footwear by pulling strands, with its features, modules and tools, including the STRAND GUIDE MODULE, associated to a technique of modeling and sewing strategy, capable of assembling footwear, in a single procedure, with increased productivity, quality and comfort and at a reduced cost.

THE INVENTION

The Strand Guide Module that is the object of the present application for Patent is composed by a set of technical parts and application technique directed towards adjusting the vector angles and adjusting the strand pulling positions for assembling the shoe uppers. This module is coupled to the machine for assembling shoe uppers by pulling strands—BR 10 2015 013357 0, filed by the now applicant, and its functions are complementary and associated to the features already existing in the equipment cited, its use in other equipment of its kind not being discarded.

The module of this invention is composed of an angular motion articulated arm (B FIG. 4B), retractable support longitudinal regulating rod (S FIG. 4B) and strand guide roller (R2 FIG. 4B), with a support (G FIG. 4B).

OBJECTIVE OF THE INVENTION

The set of solutions composed by the STRAND GUIDE MODULE, its application technique and the X-SEWING METHOD FOR ASSEMBLING SHOE UPPERS BY THE TIED STRAND SYSTEM enhance the features of the SHOE UPPER MOUNTING MACHINE WITH STRAND PULLER and is fundamental for footwear assembly by strand-pull, with snug fit, of the shoe upper to the last, for all known footwear models, but especially for models having a more complex angular variation (negative and positive angles), such as, for example, high-heeled shoes, high upper shoes, footwear with short or long tops.

After generating these complementary features, with the STRAND GUIDE MODULE it has been possible to fully eliminate the use of locks for adjusting the waist, considerably improving the quality and comfort of the footwear, in addition to economizing with raw materials and productivity improvement. Subsequently, it has also been possible to eliminate the need for more than one cross-stitching, in footwear with more complex angular variations, observing the underlying concept of this technology, which determines a direct relation between the correct position and the correct vector angle for pulling the strand, in relation to the last and the dimensional (angular) variations of the last, or of the footwear to be assembled, setting a position and a specific pulling angle for each footwear model, as per FIG. 3B, which shows the use of this module adjusted to the vector V1 of pulling the strand in an angular position in relation to the sole of the footwear (A FIG. 3B), where the tension of the strand acts sequentially, pulling the shoe upper in the vector N FIG. 3B, adjusting the shoe upper in the instep region (V FIG. 10B) and subsequently in the forepart (BI FIG. 10B), in the central part (CE FIG. 10B) and finalizing in the rear part of the shoe (TZ FIG. 10B).

Therefore, THE STRAND GUIDE MODULE is a complement of the MACHINE FOR ASSEMBLING SHOE UPPERS, and accordingly brings advantages equal to or greater than those provided by the preceding MACHINE.

DESCRIPTION OF THE DRAWINGS

The invention will now be described in an embodiment, and for a better understanding, reference will be made to the accompanying drawings, wherein.

DETAILED DESCRIPTION OF THE INVENTION

The STRAND GUIDE MODULE AND APPLICATION IN A MACHINE WITH STRAND PULLER that is the object of this application for Patent of Invention, makes it possible to fully eliminate completely the use of locks for waist adjustment, considerably improving the quality and the comfort of the footwear, besides economizing on raw materials and improving productivity.

Figure 1B:
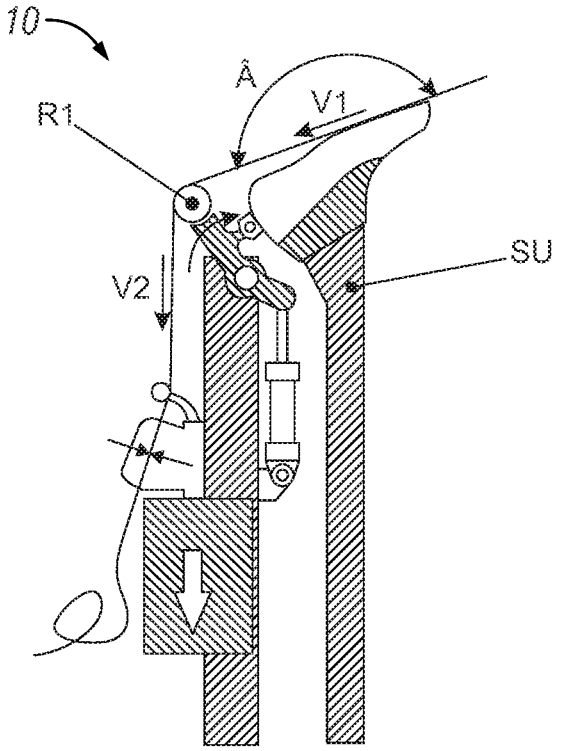
FIG. 1B: Illustrates the strand guide module with normal roller.
Figure 2B:
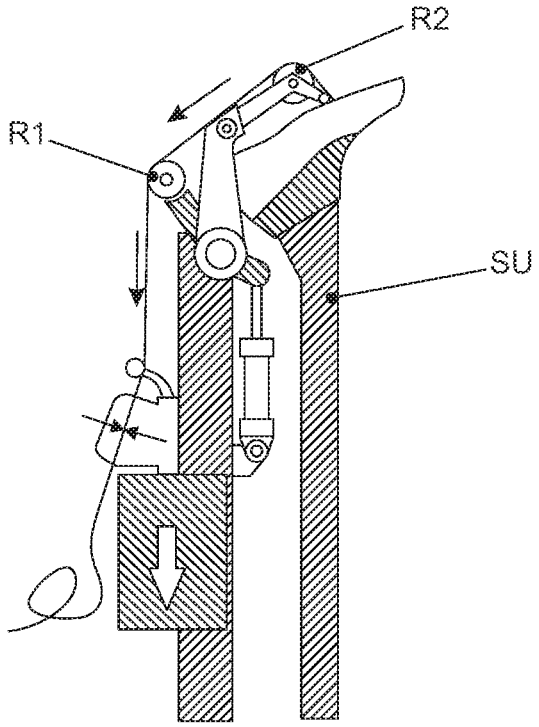
FIG. 2B: Illustrates the strand guide module with additional guide roller.

Further according to the invention, the strand guide module 10 has modularity, where the tension equipment may or may not contain strand guide modules, as shown in FIGS. 1B and FIG. 2B.

Figure 3B:
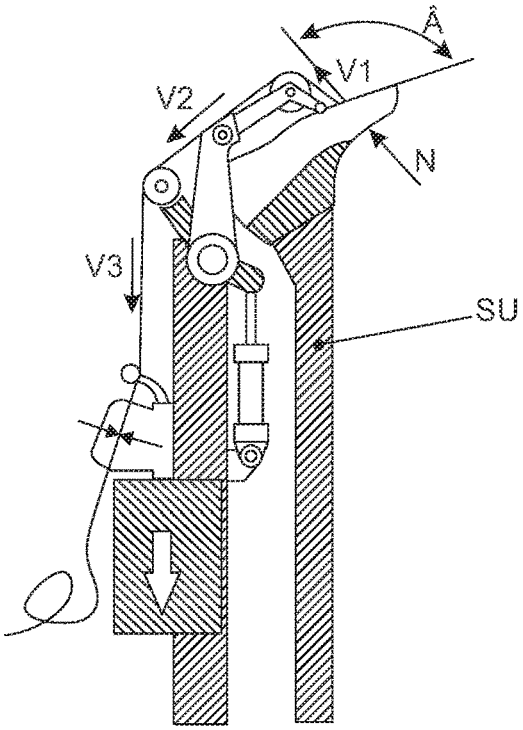
FIG. 3B: Illustrates the strand guide module showing the tension vector of the strands.
Figure 10B:
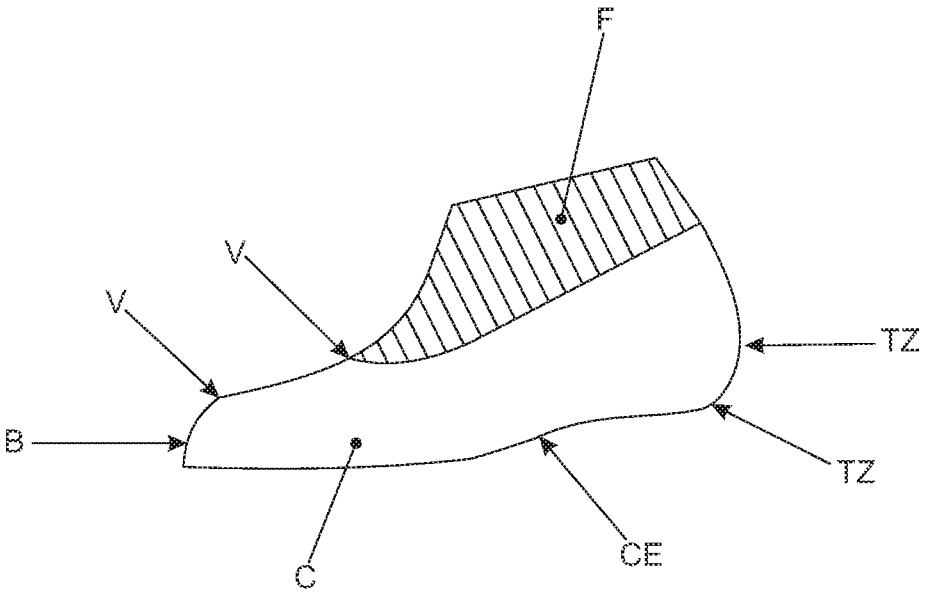
FIG. 10B: Shows the adjustment indications on the footwear used as example.

Another characteristic of the invention is to eliminate the need for more than one cross-stitch, in footwear with more complex angular variations, observing the underlying concept of this technology, which determines a direct relation between the correct position and the correct vector angle for pulling the strand, in relation to last and the dimensional (angular) variations of the last, or of the footwear to be mounted, establishing a position and a specific pulling angle for each footwear model, as per FIG. 3B, illustrating the use of this module adjusted to the vector (V1) of pulling the strand in an angular position in relation to the sole of the footwear (A)—FIG. 3B—, so that the strand tension acts sequentially, pulling the shoe upper in the vector (N)—FIG. 3B—, adjusting the shoe upper in the instep region (V)—FIG. 10B—and subsequently in the forepart (BI)—FIG. 10B—, in the central part (CE)—FIG. 10B—and finalizing in the rear part of the shoe (TZ)—FIG. 10B.

Figure 5B:
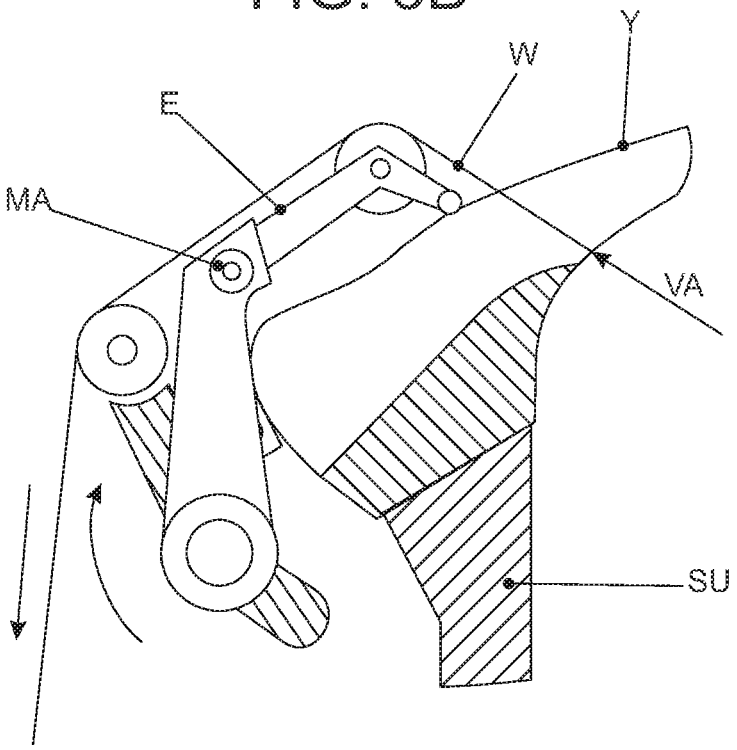
FIG. 5B: Illustrates the strand guide module showing the vector regulation of the strand to angle A near 130 degrees.
Figure 6B:
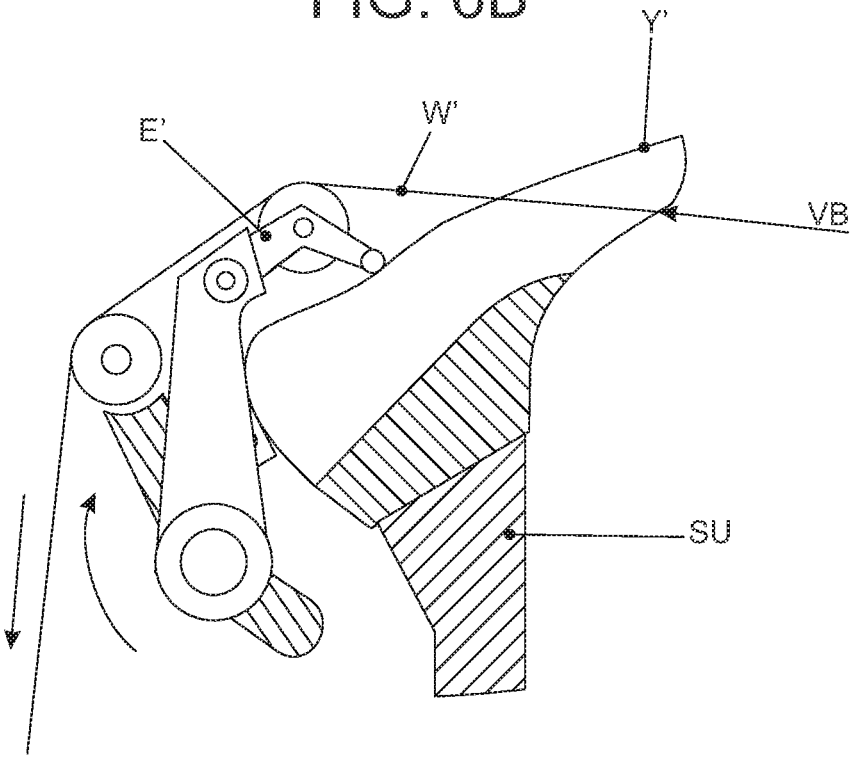
FIG. 6B: Illustrates the strand guide module showing a vector regulation of the strand A near 160 degrees.
Figure 7B:
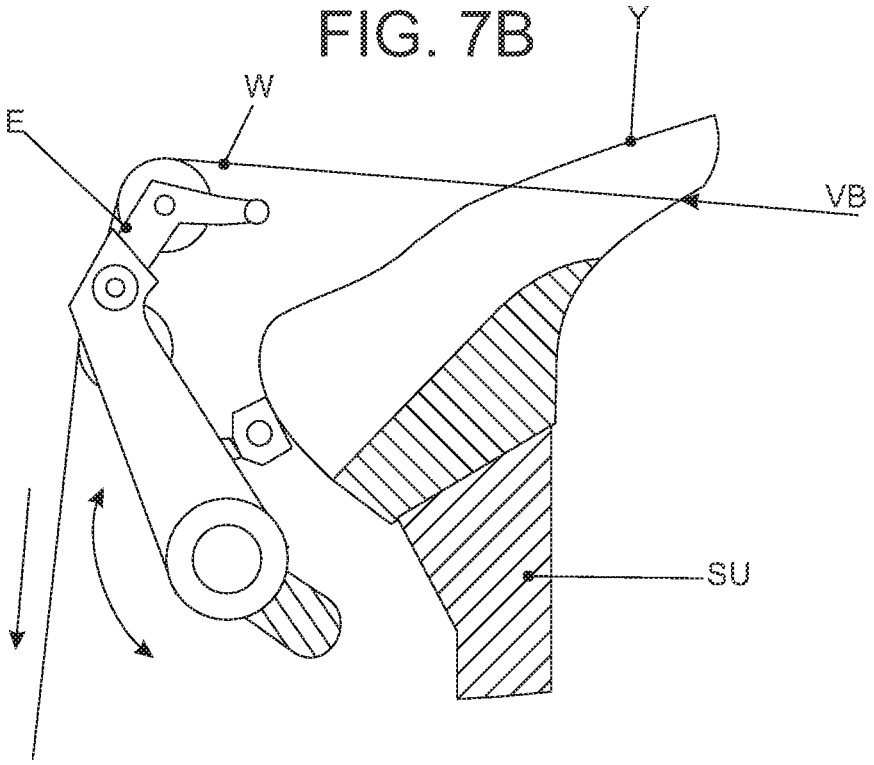
FIG. 7B: Illustrates the strand guide module showing the adjustment of the vector angle of the strand tension.
Figure 8B:
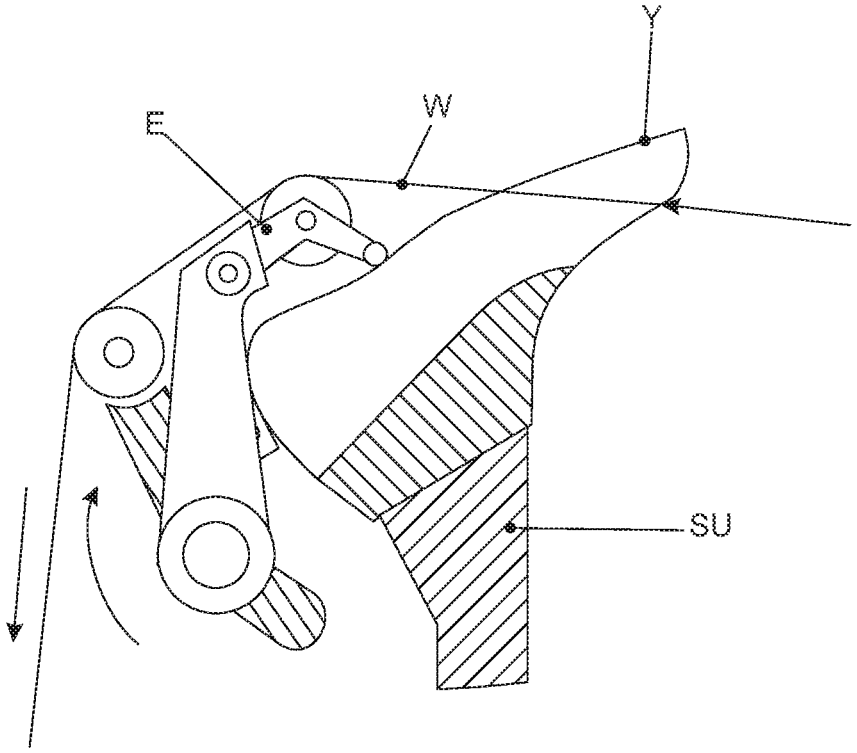
FIG. 8B: Illustrates the strand guide module showing the longitudinal, latitudinal and angular adjustment of the pulling vector of the strands.

The objective, from the technical point of view of the object of the invention, that is, the Strand Guide Module, is to permit the variation of the vector angle (A) of strand tension (W)—FIG. 5B—and (W')—FIG. 6B—, in relation to the sole of the last, or of the footwear (Y)—FIG. 5B—and (Y')—FIG. 6B—, at the moment of assembling the shoe upper, whereby defining the correct sequence of effects of the strand tension printed on the shoe upper (C)—FIG. 10B—on the last (F)—FIG. 10B at the moment of assembling by strand pulling machine system, as shown in the vectors (V)—FIG. 10B—of the instep; (BI)—FIG. 10B—of the forepart; (CE)—FIG. 10B—of the center and (TZ)—FIG. 10B—of the rearpart.

This module assembly and application technique extends the features of the mounting machine, developed by the applicant and is fundamental for sealing the shoe upper to the last, principally when so requested, as in certain regions of the foot, where greater tension effect of the strands is required, such as, for example, boots, scarpins, high-heeled shoes, ankle boots, occupational and EPIs, as seen in the tension vectors (V1) and consequent angles (A) compared in figures FIG. 1B, containing a simple guide and FIG. 3B containing the additional module of the invention.

The module illustrated and described herein discloses the physical characteristics, from the point of view of functional engineering architecture of the process and describes the essence of this functionality (E)—FIG. 5B—and (E')—FIG. 6B—, which can be reproduced and applied regardless of the design of this tool, or from the motive power source of the movements, or of the degree of automation installed therein, be it automated, computerized, or by operator control, as they are all based on the same principle as reported and described as underlying concept of this technology.

According to its operational characteristic, the Strand Guide Module according to the invention provides a tension of directed strands, with freedom of movements for adjusting positions, in longitudinal and angular directions, such that it achieves its objective which is to establish an assembly with snug fit of the shoe upper (C)—FIG. 10B—to the last (F)—FIG. 10B.

Figure 9B:
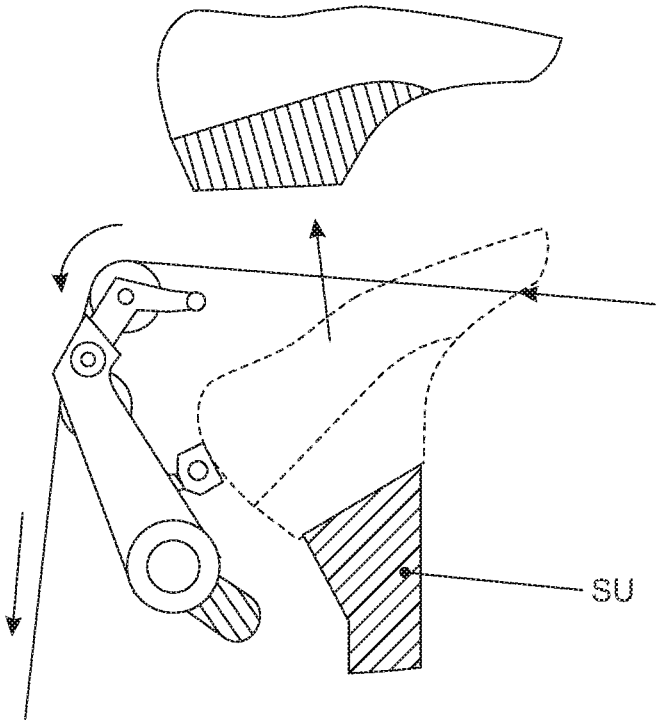
FIG. 9B: Illustrates the replacement of the last with the shoe upper.

Another functional purpose is the provide the freedom of fast movements, for approach and retreat of the strand guide, giving space for the exchange of services, to be carried out on the machine, as per FIG. 9B.

The constructive form of the Strand Guide Module of the solution to the underlying concept and to the technique of applying this combination. Nevertheless, the constructive form of the mechanical module can be modified, altered, substituted by direct tension or automated provided that the underlying concept is preserved.

The underlying concept, on which the architecture and engineering of this module was based, is to provide the correct position and the correct vector angle for pulling the strand, in relation to the last, at the moment of assembling the shoe upper, allowing adjustments, according to the dimensional variations of each last or footwear model. This underlying concept was generated after the invention of the SHOE UPPER MOUNTING MACHINE WITH STRAND PULLER and in association with the development of the X-SEWING METHOD FOR ASSEMBLING SHOE UPPERS BY THE TIED STRAND SYSTEM (BR 10 2016 024771 3), an evolution of the system known as strandlaster, which used to be limited to the assembly of light footwear, and which now encompasses all known footwear models.

For the sake of clarity, the applicant developed and filed the patent for the equipment for assemblying shoe uppers by strand tension, with intelligent control of speed and strength, support of rearpart for last, strand guide roller, vertical and horizontal regulations, transparent protection, among other features, capable of assembling, in a single procedure, all known footwear models, no longer restricting the strand method to the assembly of light footwear. After the creation of the machine, initially, the applicant developed a methodology of modeling, for adapting models mounted by traditional methods, to the strand method. This methodology has already established advances, as compared to the traditional modeling methods, as it determined a more economical and assertive constructive form, bring higher quality and comfort to footwear, reducing assembly margins, replacing stiffer components for more flexible and cheaper components, consequently reducing the production of waste. Additionally, the assembly system proposed by the applicant, also reduced the need for re-heating the shoe upper multiple times, for collages and shaping, which caused a reduction in the consumption of electric energy.

As technology evolves, by applying tests, developed and administered by the applicant, by studying each footwear model and the most efficient way to adapt them to the strand method, extracting from this technique to greatest number of benefits, the cross-sewing strategy arose, or an X-sewing strategy, the priority of which was also filed for by the applicant. Initially developed to improve the adjustment of the shoe upper on the points of negative angles, both relative to the waist, and to the height of the heel, and replace the need for other locks (fabric or nails), reducing the operating cost and consumption of raw materials. Accordingly, the applicant created and tested the sewing with more than one cross, as per the need arising from the angles of the footwear. However, the definitive solution came with the creation and the development of the Strand Guide Module, for adjusting the positioning of the vector angle of strand tension.

During studies and testing, it was noted that the strand tension, while exerting a proportional strength, simultaneously directing the edges of the shoe upper to the lower center of the last, would occur at slightly different times, as per the strength imparted by the positive angles of the last. Based on this observation, it is concluded that the direction of strand tension could determine which points of the last, should first exert strength, that is, as per the strand pull angle, could determine the sequence of closing the shoe upper, establishing the order of closure as per the footwear model. In this way, footwear with high upper, for example, should be sealed, firstly, in the upper region of the foot (instep), then in the forepart, in the waist and lastly in the rearpart. The result of this sequence would be the full, proportional, symetric and simultaneous closure, guaranteeing equivalent edges and perfect sealing. This factor provided the full adjustment of the shoe upper to the last, the maximum efficiency, without the use of fabric locks or nails, with a single cross-stitch.

Technically, for a product to be produced on an industrial scale, it is necessary to establish a production logic, from the knowledge of the determining factors of each product and its possible variables, making the sequential process of manufacture feasible.

In the production of footwear it should be no different, therefore, in assembling footwear by the strand method, by the equipment developed by the applicant, added to the features of the Strand Guide Module of this invention, freedom of movement, described herein and to the cross-stitching method, also developed by the company, the previously established coordinates can be used, position and tension angles, of each model of footwear to be manufactured, to attribute a sequential production of this footwear, even with different models, guaranteeing high productivity and repetition of results, maintaining the same quality.

Figure 4B:
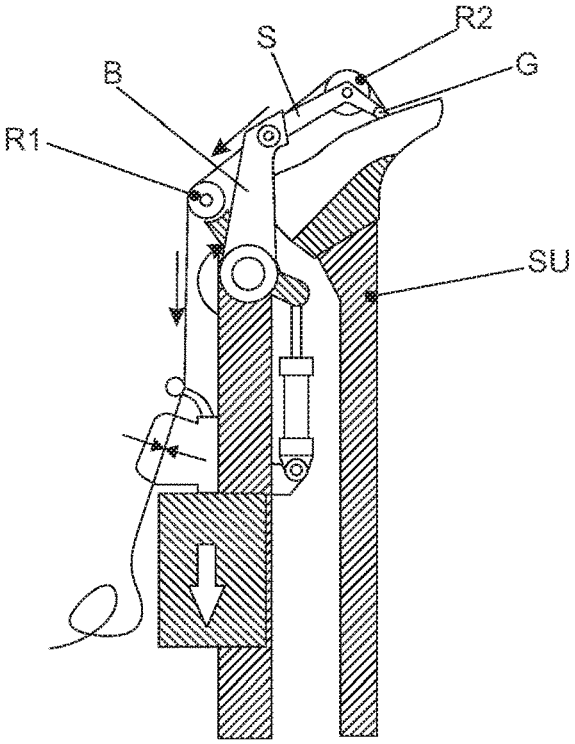
FIG. 4B: Illustrates the strand guide module showing the adjustable support position.

Accordingly, when positioning the last with the shoe upper (FIG. 10B) on the support of the mounting machine (SU)—FIGS. 1B to 9B—, loosening the handle (MA)—FIG. 5B—and adjusting the retractable rod (E)—FIG. 5B and (E')—FIG. 6B—in the longitudinal direction of the footwear, and the positioning of the guide roller (R2)—FIG. 4B—in the position where the strand of assembly establishes angle (A)—FIG. 5B—and (A)—FIG. 6B—, according to the needs of each model. Having made this adjustment, the handle (MA)—FIG. 5B—it must again be tightened and follow on with the assembly sequence by pulling the strands.

By adjusting the angular vector of the strand in relation to the last, using the strand guide module, the sequence of strand pulling effects on the shoe upper is determined.

FIG. 1B shows a flat sole shoe, with negligible heel, where the tension vector of the strand is parallel to the sole of the footwear, called angle zero. Therefore, without the use of the strand guide module, with support guide, there is no option and strategy feasible for vector-angle adjustments of the strand tension.

FIG. 3B shows the use of the module of the invention, adjusted to the vector (V1) for pulling the strand, in angular position, in relation to the footwear sole (A)—FIG. 3B—, where the tension of the strand acts sequentially, pulling the shoe upper in the vector (N)—FIG. 3B—, adjusting the shoe upper in the instep region (V)—FIG. 10B—, subsequently in the forepart (BI)—FIG. 10B—, then in the central part (CE)—FIG. 10B—and finalizing in the rear part of the shoe (TZ)—FIG. 10B.

FIG. 5B shows a vector regulation of the strand, angle-adjusted (A) near 130 degrees, which enhances the tension of the shoe upper in the high region of the instep, called the upper (VA)—FIG. 5B.

FIG. 6B shows a vector regulation of the strand angle-adjusted (A) near 160 degrees, which enhances the tension in the high region of the instep and divides this tension with the region near the forepart of the shoe (VB)—FIG. 6B.

The invention claimed is:

1. A method for adjusting the pulling vector of a strand of a strand guide module, the method comprising:

adjusting a length of an adjustable rod arm of the strand guide module;

wherein shortening the length of the adjustable rod arm increases an angle of the pulling vector of the strand in relation to a sole of a footwear; and wherein increasing the length of the adjustable rod arm decreases the angle of the pulling vector of the strand in relation to a sole of a footwear.

2. The method according to claim 1, further comprising loosening a handle (MA) of the strand guide module, adjusting the adjustable rod arm (E) in a longitudinal direction of the footwear, reaching a positioning of a guide roller (R2) where the assembly strand sets the angle (A), according to the needs of each model.

3. The method according to claim 2, wherein the adjustment of the adjustable rod arm promotes the tension of directed strands, with freedom of movement, for adjusting positions, in longitudinal and angular directions, establishing an assembly with snug fit of the shoe upper (C).

4. The method according to claim 3, wherein adjusting the angular vector of the strand, in relation to the last, using the strand guide module, the sequence of effects of strand tension on the shoe upper is determined.

5. The method -according to claim 1, wherein the angle is adjusted (A) 130 degrees, enhancing the tension of the shoe upper in the high region of the instep, called the upper (VA).

6. The method according to claim 1, wherein the angle is -adjusted (A) near 160 degrees, which attenuates the tension in the high region of the instep and divides this tension with the region near the forepart of the shoe (VB).

7. The method of claim 2, further comprising tightening the handle after adjusting the adjustable rod arm.

* * * * *